US005123685A

United States Patent [19]

Donovan

[11] Patent Number: 5,123,685

[45] Date of Patent: Jun. 23, 1992

[54] DOOR STOP APPARATUS FOR KEEPING DOOR AJAR

[76] Inventor: Stanley W. Donovan, 1768 Elsmere, Windsor, Ontario, Canada, N8X 4H4

[21] Appl. No.: 779,330

[22] Filed: Oct. 18, 1991

[51] Int. Cl.[5] ..... E05C 17/04

[52] U.S. Cl. ..... 292/262; 16/86 A; 16/82; 292/145; 292/263; 292/DIG. 65

[58] Field of Search ..... 292/137, 145, 262, 263, 292/216, 218, 213, DIG. 19, DIG. 71, DIG. 65, DIG. 56; 16/82, 86 R, 86 A, 86 B, 86 C; 49/383, 384; 109/60

[56] References Cited

U.S. PATENT DOCUMENTS

| | | | |
|---|---|---|---|
| 264,438 | 9/1882 | Burrill | 16/86 A |
| 1,414,286 | 4/1922 | Keller | 16/86 A |
| 1,544,464 | 6/1925 | Long | 292/218 |
| 2,107,699 | 2/1938 | Groeschel et al. | 16/86 R |
| 2,565,906 | 8/1951 | Berthene | 16/86 A |
| 2,807,044 | 9/1957 | Blondy | 16/86 A |
| 3,055,043 | 9/1962 | Lutner, Jr. | 16/86 B |
| 3,758,141 | 9/1973 | Weinberger | 292/262 |
| 4,015,867 | 4/1977 | Siden | 292/262 |
| 4,930,818 | 6/1990 | Gerhardsson | 292/DIG. 71 |
| 4,982,474 | 1/1991 | Kjellström | 16/82 |

*Primary Examiner*—Eric K. Nicholson
*Attorney, Agent, or Firm*—Hugh E. Smith

[57] ABSTRACT

A door stop apparatus is arranged for securement to a door for cooperation with a door jamb, wherein a bracket mounting the slide portion of the organization includes an abutment leg orthogonally mounted to a slide bar and the slide bar further includes an abutment flange limiting projection of the abutment leg beyond the associated door relative to the support bracket. A modification of the invention includes a crossed tubular bracket structure utilizing a severed abutment leg within each tube section, and each abutment leg relative to an associated slide member is of a varying length to provide for adjustment of gap of an associated door relative to an associated door frame.

4 Claims, 4 Drawing Sheets

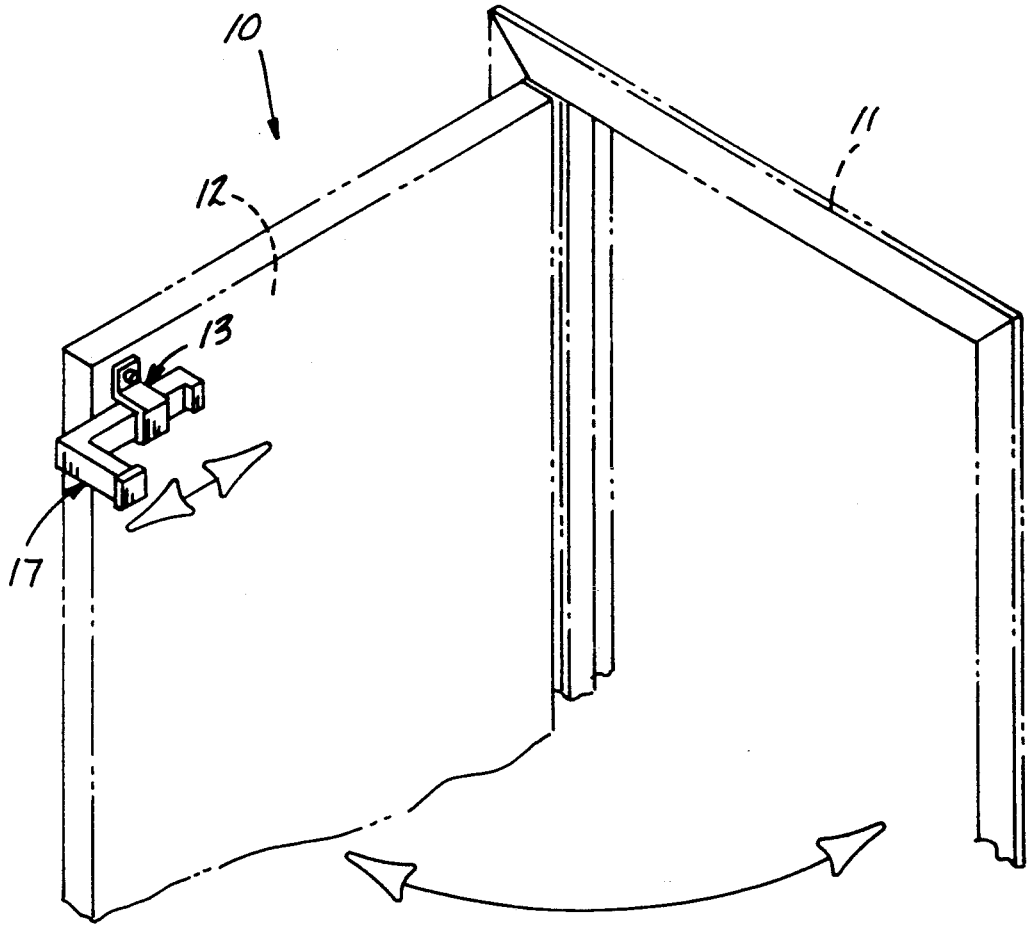
Fig 1
Fig 2
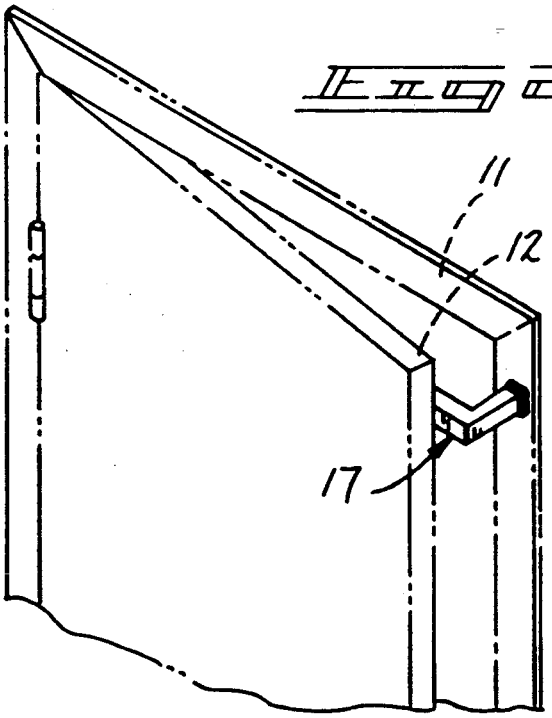

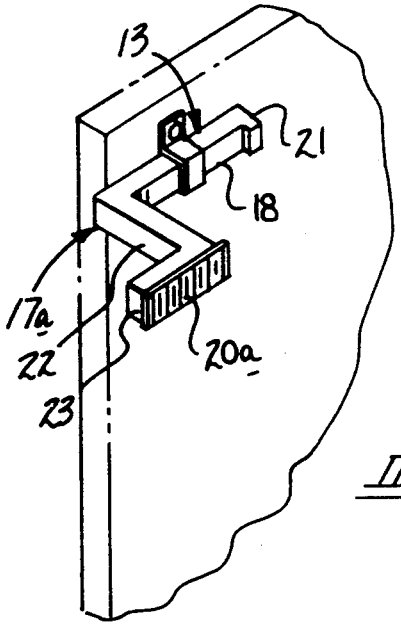
FIG 11
FIG 12
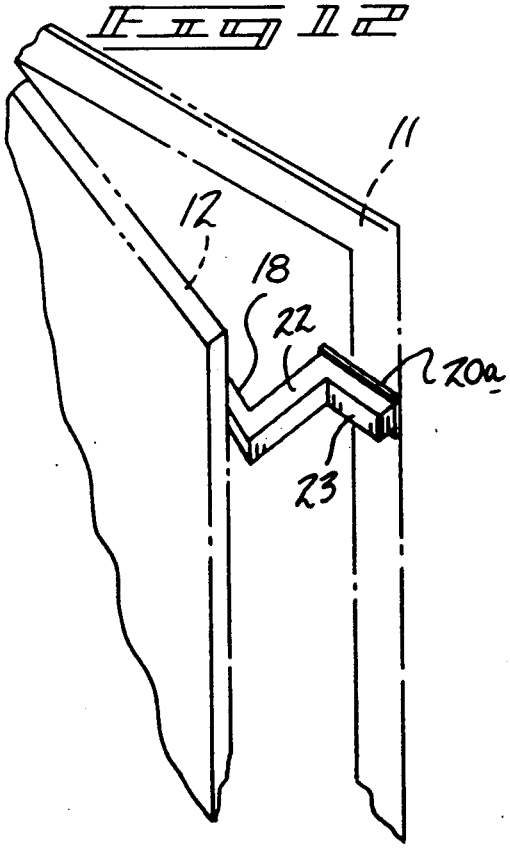
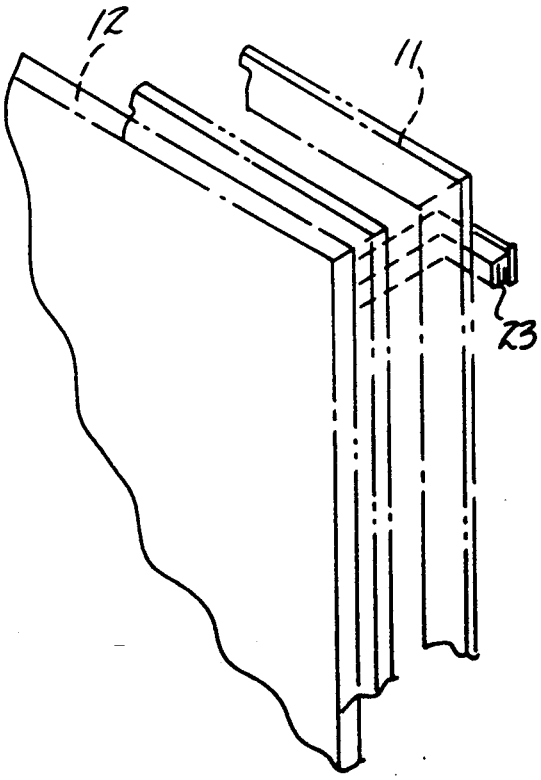
FIG 13

DOOR STOP APPARATUS FOR KEEPING DOOR AJAR

BACKGROUND OF THE INVENTION

1. Field of the Invention

The field of invention relates to door apparatus, and more particularly pertains to a new and improved door stop apparatus wherein the same is arranged to provide for relative abutment of a door relative to the door frame to space the door relative to the door frame in use.

2. Description of the Prior Art

Abutment structure to present a door complete closing relative to a door frame is desirable to prevent inadvertent injury to individuals, such as children and the like, in the closing of doors relative to a door frame structure. Such apparatus is exemplified in U.S. Pat. No. 4,684,158 to Miclot utilizing a device for maintaining a door in an opened position.

U.S. Pat. No. 4,261,140 to McLean sets forth a stop device to maintain a door from closing completely relative to a door frame structure.

As such, it may be appreciated that there continues to be a need for a new and improved door stop apparatus as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of door stop apparatus now present in the prior art, the present invention provides a door stop apparatus wherein the same provides for selective projection of the abutment leg of the organization relative to a door frame preventing complete closure of the door relative to the door frame. As such, the general purpose of the present invention, which will be described subsequently in greater detail, is to provide a new and improved door stop apparatus which has all the advantages of the prior art door stop apparatus and none of the disadvantages.

To attain this, the present invention provides a door stop apparatus arranged for securement to a door for cooperation with a door jamb, wherein a bracket mounting the slide portion of the organization includes an abutment leg orthogonally mounted to a slide bar and the slide bar further includes an abutment flange limiting projection of the abutment leg beyond the associated door relative to the support bracket. A modification of the invention includes a crossed tubular bracket structure utilizing a severed abutment leg within each tube section, and each abutment leg relative to an associated slide member is of a varying length to provide for adjustment of gap of an associated door relative to an associated door frame.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved door stop apparatus which has all the advantages of the prior art door stop apparatus and none of the disadvantages.

It is another object of the present invention to provide a new and improved door stop apparatus which may be easily and efficiently manufactured and marketed.

It is a further object of the present invention to provide a new and improved door stop apparatus which is of a durable and reliable construction.

An even further object of the present invention is to provide a new and improved door stop apparatus which is susceptible of a low cost of manufacture with regard to both materials and labor, and which accordingly is then susceptible of low prices of sale to the consuming public, thereby making such door stop apparatus economically available to the buying public.

Still yet another object of the present invention is to provide a new and improved door stop apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is an isometric illustration of the invention in position relative to a door structure.

FIG. 2 is an isometric illustration of the instant invention maintaining the door in a spaced relationship relative to a door frame.

FIG. 11 is an isometric illustration of a modification of the invention.

FIG. 12 is an isometric illustration of the modified structure to maintain the door in a spaced relationship relative to the door frame.

FIG. 13 is an isometric illustration of the modification of the invention illustrating the structure in a second position to effect locking of the door relative to the door frame.

DESCRIPTION OF THE PREFERRED EMBODIMENT

Figure 4:
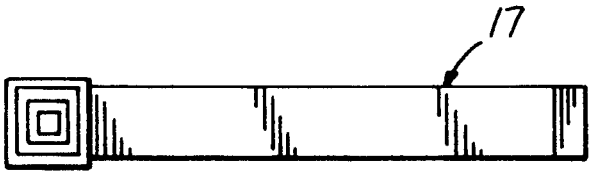
FIG. 4 is an orthographic front view of the abutment bar of the invention.
Figure 3:
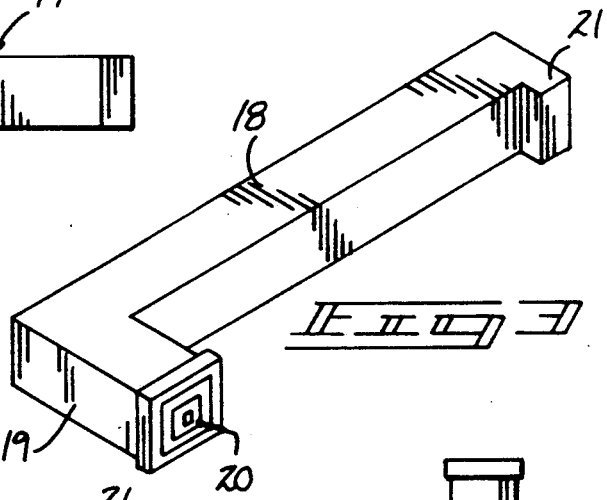
FIG. 3 is an isometric illustration of the abutment bar of the invention.
Figure 5:
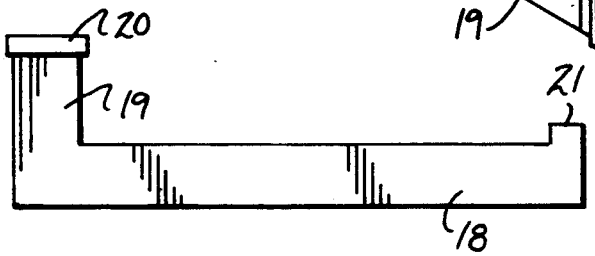
FIG. 5 is an orthographic side view of the abutment bar of the invention.
Figure 6:
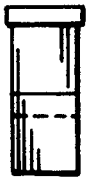
FIG. 6 is an orthographic end view of the abutment bar of the invention.
Figure 8:
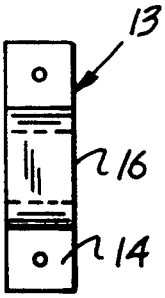
FIG. 8 is an orthographic top view of the bracket.
Figure 7:
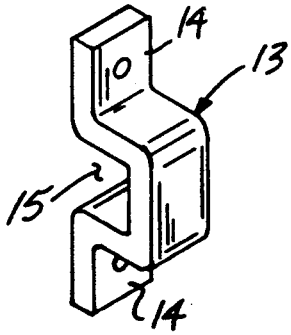
FIG. 7 is an isometric illustration of the bracket structure mounting the abutment bar utilized by the invention.
Figure 9:
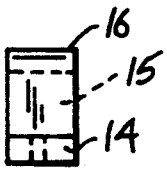
FIG. 9 is an orthographic end view of the bracket.
Figure 10:
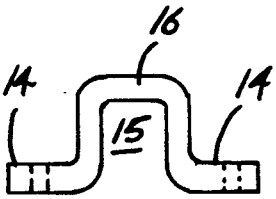
FIG. 10 is an orthographic side view of the bracket.

With reference now to the drawings, and in particular to FIGS. 1 to 15 thereof, a new and improved door stop apparatus embodying the principles and concepts of the present invention and generally designated by the reference numerals 10 and 10*a* will be described.

More specifically, the door stop apparatus 10 of the instant invention essentially comprises a conventional "U" shaped door frame 11 pivotally mounting a door 12 therewithin. The door 12 is arranged to receive a support bracket 13 formed with a plurality of spaced coplanar bracket legs 14 that are longitudinally aligned relative to one another to receive a "U" shaped bracket portion 16 therebetween to define a support bracket central recess 15 defined by a predetermined parallelepiped cross-sectional configuration. An abutment bar 17 is slidably received within the support bracket 13, and more specifically within the central recess 15, and wherein the abutment bar 17 includes a central leg 18 of a first length and defined by a cross-sectional configuration equal to the predetermined cross-sectional configuration to be complementarily received within the recess 15. An abutment leg 19 orthogonally projects rearwardly of the abutment bar 17 at a forward distal end thereof and is defined by a first length, including a resilient pad 20 mounted at a free distal end surface of the abutment leg 19 arranged parallel relative to the central leg 18. An abutment flange 21 defined by a second length less than the first length is arranged orthogonally relative to the central leg 18 and integrally mounted at a rear distal end of the central leg 18 in a parallel spaced confronting relationship relative to the abutment leg 19. In this manner, when the central leg 18 is slid to a second position, such as illustrated in FIG. 1, from a first position, in the second position the abutment leg 19 projects beyond the door 11 from a first position contained within the door 11 to effect abutment onto the frame 11 preventing closure of the door 12 relative to the frame 11.

FIGS. 11–13 illustrate a modified abutment bar 17 to include a first abutment leg 22 of the first length, that in turn is substantially equal to the width of the door frame 11. A second abutment leg 23 is orthogonally mounted to a forward distal end of the abutment leg spaced from the central leg 18 extending beyond the central leg 18 in a parallel relationship to include a modified resilient pad 20 arranged parallel relative to the central leg 18, wherein the second abutment leg 20*a* may act as an abutment to prevent closure of the door 12 or alternatively, such as illustrated in FIG. 13, effect closure and latching of the door 12 relative to the frame 11.

Figure 14:
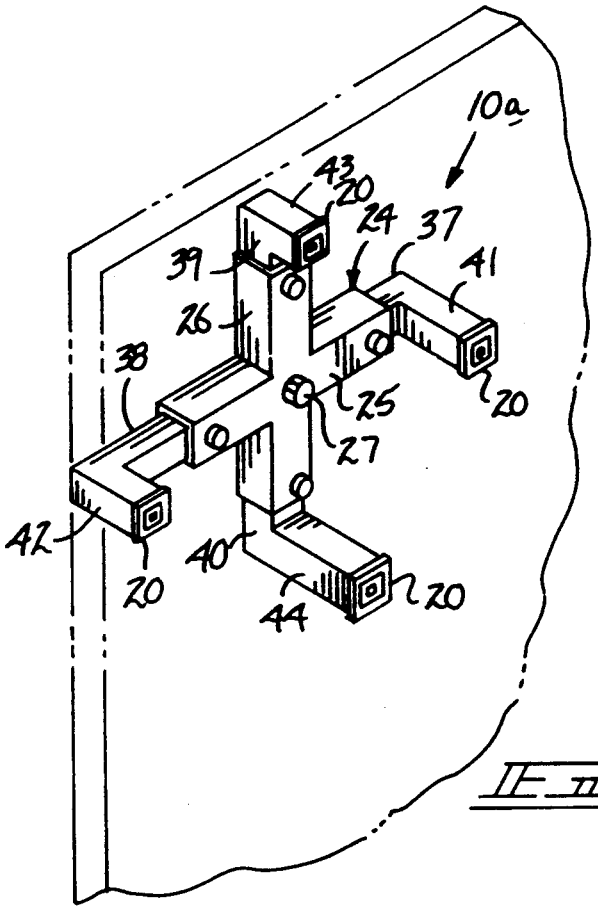
FIG. 14 is an isometric illustration of a further modified aspect of the invention.
Figure 15:
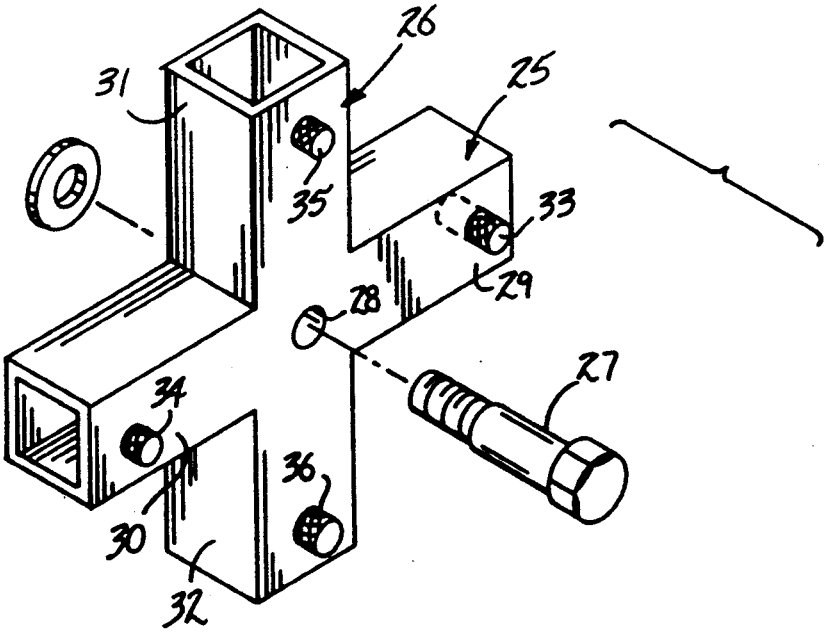
FIG. 15 is an isometric enlarged illustration of the modified support bracket of the invention as set forth in FIG. 14.

FIGS. 14 and 15 illustrate a modified support bracket 24, including a first rectilinear tube 25 orthogonally oriented relative to a second rectilinear tube 26, each of an equal predetermined length. The first and second tubes 25 and 26 orthogonally intersect medially relative to one another at an intersection with an axle shaft bore 28 orthogonally directed through the intersection and orthogonally oriented relative to the support bracket 24. An axle shaft 27 directed through the axle shaft bore 28 rotatably mounts the bracket 24 thereabout. A first rectilinear tube 25 defines a respective first tube first portion and a first tube second portion 29 and 30 respectively on opposed sides of the axle shaft 27, with the second tube 26 defining a respective second tube first portion and a second tube second portion 31 and 32 respectively on opposed sides of the axle shaft bore 28. A first and second detent lock 33 and 34 respectively are formed of an externally threaded boss threadedly received through the respective first tube first and second portions 29 and 30 respectively to frictionally engage an associated slide bar therewithin. A third and fourth detent lock 35 and 36 are threadedly directed orthogonally through the second tube first and second portions 31 and 32 respectively for the same purpose. A first slide bore 37 is slidably received within the first tube first portion 29, a second slide bar 38 is slidably received within the first tube second portion 30. Similarly, a third slide bar 39 is slidably received within the second tube first portion 31 and a fourth slide bar 40 is slidably received within the second tube second portion 32, each of an equal predetermined length. A respective first, second, third, and fourth abutment leg 41, 42, 43, and 44 of an unequal length are orthogonally oriented relative to a free distal end of the respective first, second, third, and fourth slide bars 37, 38, 39, and 40. Specifically, the third abutment leg 43 is of a length greater than the second abutment leg 42, which is of a length greater than the first abutment leg 41, which in turn is of a length greater than the fourth abutment leg 44, each including a respective resilient pad 20 that is arranged parallel to the associated respective slide bar. The various sized abutment legs 41–44 permit adjustment of a gap between the associated door frame 11 and door 12 in use, wherein the bracket 25 is rotatable relative to the axle 27 to permit orientation of a desired slide bar and abutment leg in orientation relative to the door frame, with a respective detent lock arranged to permit latching projection or retraction of that respective slide bar relative to its associated tube portion 29–32.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A door stop apparatus for securement to a door, wherein the door is pivotally mounted to a "U" shaped door frame, and wherein the apparatus includes a support bracket mounted to the door adjacent a vertical side edge thereof, and wherein the support bracket includes at least one abutment bar slidably mounted relative to the support bracket, the abutment bar includes a slide bar complementarily and slidably received within the support bracket, and wherein the slide bar is arranged for projection from a first position recessed rearwardly of a vertical door edge to a second position projecting beyond the vertical door edge, and the slide bar including an abutment leg orthogonally and integrally mounted to a free distal end of the slide bar exteriorly of the support bracket, and the abutment leg including a resilient pad mounted to a free end portion of the abutment bar parallel to the slide bar, and the support bracket includes a first rectilinear tube orthogonally oriented to and intersecting a second rectilinear tube medially of the second rectilinear tube and the first rectilinear tube at an intersection, and the intersection including an axle shaft bore directed coextensively therethrough, wherein the axle shaft bore is orthogonally oriented relative to the support bracket, and the first rectilinear tube including a first tube first portion and a first tube second portion on opposed sides of the axle shaft bore, and the second tube including a second tube first portion and a second tube second portion on opposed sides of the axle shaft bore, and the axle shaft bore including an axle shaft directed therethrough, wherein the axle shaft is arranged for orthogonal securement to the door, and wherein the shaft defines a first slide bar slidably and complementarily received within the first tube first portion, and a second slide bar complementarily and slidably received within a first tube second portion, and a third slide bar complementarily and slidably received within the second tube first portion, and a fourth slide bar complementarily and slidably received within the second tube second portion, the second slide bar including a second abutment leg orthogonally mounted to a free distal end of the second slide bar exteriorly of the first tube second portion, the third slide bar including a third abutment leg orthogonally and integrally mounted to a free distal end of the third slide bar exteriorly of the second tube first portion, and the fourth slide bar including a fourth abutment leg orthogonally and integrally mounted to a free distal end of the fourth bar exteriorly of the second tube second portion, wherein the abutment leg, the second abutment leg, the third abutment leg, and the fourth abutment leg are arranged parallel relative to one another.

2. An apparatus as set forth in claim 1 wherein the abutment leg is defined by a first length, the second abutment leg is defined by a second length, the third abutment leg is defined by a third length, and the fourth abutment leg is defined by a fourth length, wherein the third length is greater than the second length, the second length is greater than the first length, and the first length is greater than the fourth length to effect selective spacing of the door relative to the door frame upon projection of one of said slide bars relative to the support bracket.

3. An apparatus as set forth in claim 2 wherein the first tube first portion includes a first detent lock orthogonally directed therethrough for abutment with the first slide bar to latch the first slide bar relative to the first tube first portion, and a second detent lock threadedly and orthogonally directed through the first tube second portion to selectively lock the second slide bar relative to the first tube second portion, and a third detent lock threadedly and orthogonally directed through the second tube first portion to threadedly lock the third slide bar relative to the second tube first portion, and a fourth detent lock orthogonally and threadedly directed through the second tube second portion to threadedly lock the fourth slide bar relative to the second tube second portion.

4. An apparatus as set forth in claim 3 wherein each abutment leg includes a resilient pad, wherein each resilient pad is arranged in a parallel relationship relative to one another.

* * * * *